US010030457B2

(12) United States Patent
Rooyakkers et al.

(10) Patent No.: US 10,030,457 B2
(45) Date of Patent: Jul. 24, 2018

(54) DOWNHOLE TOOL STOP DEVICE AND METHOD FOR USE OF SAME

(71) Applicant: ARDYNE AS, Tananger (NO)

(72) Inventors: Edwin Cornelis Gerardus Rooyakkers, Tananger (NO); Steffen Hansen, Tananger (NO); Steffen Evertsen, Stavanger (NO)

(73) Assignee: ARDYNE AS, Tananger (NO)

( * ) Notice: Subject to any disclaimer, the term of this patent is extended or adjusted under 35 U.S.C. 154(b) by 0 days.

(21) Appl. No.: 15/026,932

(22) PCT Filed: Sep. 30, 2014

(86) PCT No.: PCT/NO2014/050180
§ 371 (c)(1),
(2) Date: Apr. 1, 2016

(87) PCT Pub. No.: WO2015/050458
PCT Pub. Date: Apr. 9, 2015

(65) Prior Publication Data

US 2016/0305207 A1 Oct. 20, 2016

(30) Foreign Application Priority Data

Oct. 2, 2013 (NO) ..... 20131324

(51) Int. Cl.
*E21B 23/00* (2006.01)
*E21B 23/01* (2006.01)

(52) U.S. Cl.
CPC ..... *E21B 23/00* (2013.01); *E21B 23/01* (2013.01)

(58) Field of Classification Search
CPC ..... E21B 23/00; E21B 23/01; E21B 23/03; E21B 43/10; E21B 31/30
USPC ..... 166/376
See application file for complete search history.

(56) References Cited

U.S. PATENT DOCUMENTS

| | | | |
|---|---|---|---|
| 2,824,613 | A | 2/1958 | Baker et al. |
| 2,962,313 | A | 11/1960 | Conrad et al. |
| 3,610,336 | A | 10/1971 | Sizer |
| 3,837,398 | A | 9/1974 | Yonker |
| 3,863,715 | A | 2/1975 | Yonker |
| 3,997,003 | A | 12/1976 | Adkins et al. |
| 4,311,194 | A | 1/1982 | White |

(Continued)

FOREIGN PATENT DOCUMENTS

GB 2091789 A 8/1982

OTHER PUBLICATIONS

International Search Report dated Dec. 15, 2014 for International Application No. PCT/NO2014/050180 for Wellbore AS, filed Sep. 30, 2014.

(Continued)

*Primary Examiner* — Giovanna Collins Wright
*Assistant Examiner* — Yanick A Akaragwe
(74) *Attorney, Agent, or Firm* — Perkins Coie LLP

(57) ABSTRACT

The present invention relates to a downhole-tool stop device (1) and a method of using the same, the stop device (1) comprising a first collar (4) attached to an elongated body (9), characterized by the stop device (1) including a second collar (6) attached to the elongated body (9), and the second collar (6) being displaceably attached to the elongated body (9), and the first collar (4) and the second collar (6) being placed a distance (A1) apart.

11 Claims, 3 Drawing Sheets

(56) References Cited

U.S. PATENT DOCUMENTS

| | | | | |
|---|---|---|---|---|
| 4,591,197 | A * | 5/1986 | Akkerman | E21B 23/00 294/86.17 |
| 4,681,159 | A | 7/1987 | Allwin et al. | |
| 5,735,345 | A | 4/1998 | Dobson et al. | |
| 2010/0252252 | A1 | 10/2010 | Harris et al. | |
| 2010/0252278 | A1 | 10/2010 | Harris et al. | |
| 2011/0042081 | A1 * | 2/2011 | Streich | C09K 8/42 166/269 |
| 2011/0155395 | A1 * | 6/2011 | Hendrickson | E21B 33/129 166/377 |
| 2013/0180715 | A1 | 7/2013 | Harris et al. | |

OTHER PUBLICATIONS

Supplementary European Search Report dated May 23, 2017 for European Patent Application No. EP14850507 for Wellbore AS, filed Aug. 10, 2016.

* cited by examiner

DOWNHOLE TOOL STOP DEVICE AND METHOD FOR USE OF SAME

The invention relates to a downhole-tool stop device. The invention relates more particularly to a downhole-tool stop device in a petroleum well. The stop device includes a first collar and a second collar attached to a pipe string. The second collar is provided with shear pins so that the second collar may be released on impact with a casing during operations in which a downhole tool is to be released.

In some downhole operations, a pipe string provided with a tool, which is carried into a pipe, for example a casing, is used. The tool included in the pipe string is activated a distance inside the casing. To ensure that the tool is not carried too far into the casing, it is known to arrange a stop device on the pipe string.

The stop device usually consists of a collar with a diameter larger than the bore of the casing. Thus, the tool may be brought to the desired position relative to the end of the casing by the collar meeting the end of the casing and preventing the tool from travelling further into this.

In some downhole tools it is relevant to activate grippers that grip internally in the casing. Such grippers are often formed with a serrated or toothed surface, which is arranged to engage with the pipe wall. The grippers may be formed from radially mounted segments with an internal wedge shape, so that the axial movement of a conical pressing element within the grippers may force the grippers out against the casing.

The axial movement of the conical pressing element can be activated by rotating the pipe string of which the tool forms part. Solutions are also known in which the axial movement of the conical pressing element is activated by pulling in the direction out of the casing by means of an actuator, or by stretching the pipe string.

The grippers are typically activated by the conical element being moved in the direction out of the well. By pulling on the pipe string from the surface, the gripping force may be increased by increasing the pull. The grippers may be difficult to get loose when an operation is finished or if the operation has to be interrupted. The conical pressing element must be moved in the inward direction in the well in order to release the grippers from the casing. Conical pressing elements that are activated by rotation of the pipe string may be difficult to get loose by rotation in the opposite direction and there may be a risk of such rotation loosening or overtightening threaded connections in the pipe string or in the tool without the grippers coming loose. The stop resting against the end of the pipe may make it impossible to use weight from the pipe string to force the conical element inwards in the pipe so that the grippers come loose.

A need therefore exists for a stop device that, in relation to known stop devices, allows a further travelling in the axial direction when a downhole tool is being released.

The invention has for its object to remedy or reduce at least one of the drawbacks of the prior art.

The object is achieved according to the invention through the features that are specified in the description below and in the claims that follow.

In a first aspect, the invention relates to a downhole-tool stop device, the stop device including a first collar attached to an elongated body, and the stop device including a second collar attached to the elongated body, and the second collar being displaceably attached to the elongated body, and the first collar and the second collar being placed a distance apart.

The second collar may be displaceably attached to the elongated body by at least one rupture body.

The second collar may be attached closer to the second end portion of the elongated body than the first collar. The elongated boy may consist of a pipe string.

The pipe string may consist of a two-part pipe string, and the upper section and the lower section of the pipe string may be threadedly connected.

The lower section of the pipe string may be provided with an edge portion arranged to hit the second collar.

The first collar may have a larger external diameter than the second collar.

The at least one rupture body may be taken from the group consisting of shear screws and shear pins, and the at least one rupture body may be arranged substantially perpendicularly to the longitudinal direction of the elongated body.

The downhole tool may consist of a gripping tool or a hang-off tool, and the downhole tool may be attached to the second end portion of the elongated body.

The elongated body may be taken from the group consisting of pipes, cylinders, square-head bolts, hexagon bolts, octagon bolts, triangle-head bolts, spline bolts and wires.

In a second aspect, the invention relates to a method of using a downhole-tool stop device in an underground well, the method comprising the steps of:

- attaching a downhole tool to a stop device, the stop device including an elongated body, a first stop collar and a second stop collar;
- running the downhole tool attached to the stop device in until the second stop collar of the stop device hits a casing;
- engaging the downhole tool with the casing by moving the downhole tool and the stop device in the direction out of the underground well;
- releasing the engagement of the downhole tool with the casing by moving the downhole tool and the stop device in the direction into the underground well so that the shear pins of the second stop collar break.

In what follows, an example of a preferred method and embodiment is described, which is visualized in the accompanying drawings, in which.

Figure 3:
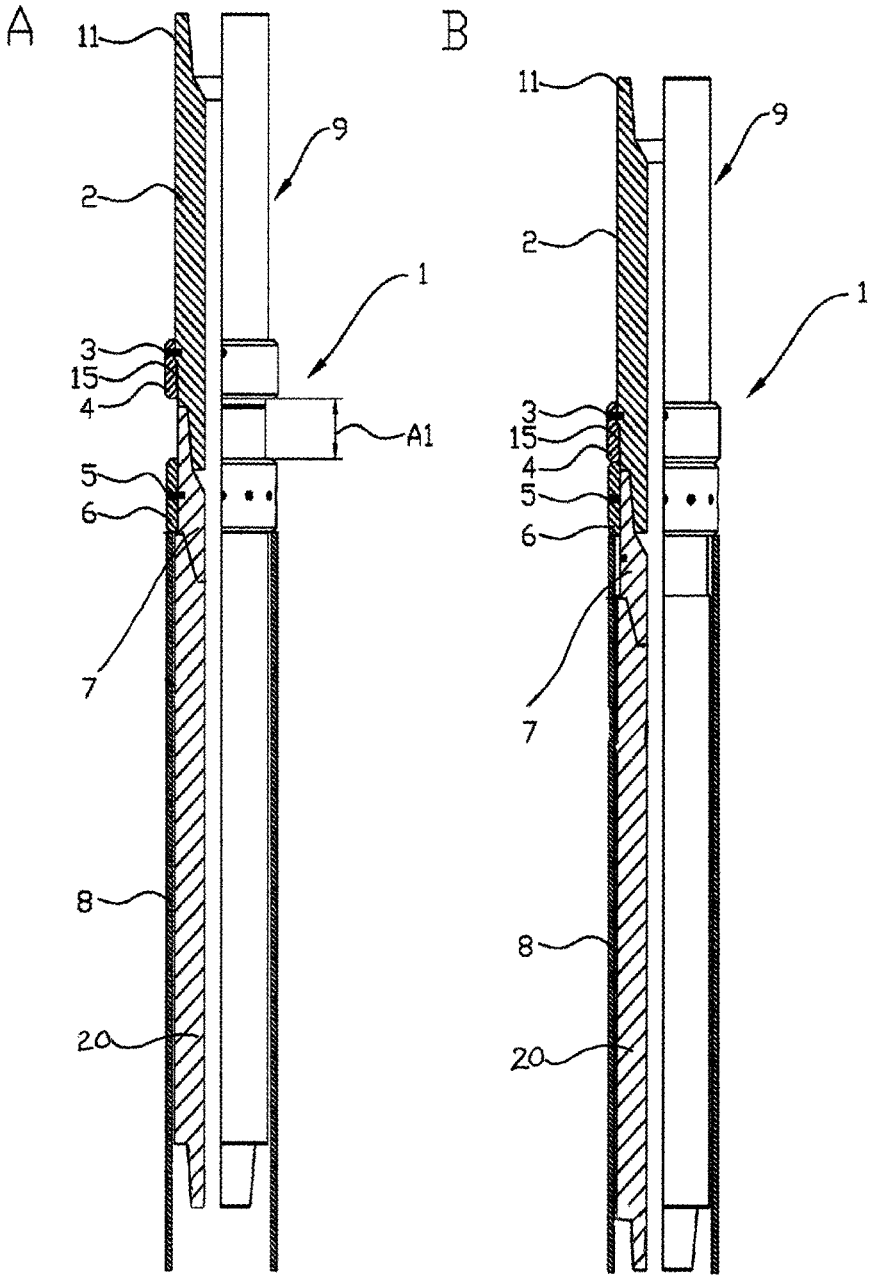

FIGS. 3A-B show a partial section of the stop device and a section of a casing.

In the description of the drawings, references to some details have been left out. These details are not essential to emphasize the novelty of the invention. These details may be of importance for the production of the apparatus, but references to them have been left out to simplify the description and clarify the invention.

Equal or corresponding elements will be indicated by the same reference numerals in the figures.

Positional specifications such as "over", "under", "above", "below", "right" and "left" refer to the positions that are shown in the figures.

In what follows, the reference numeral 1 indicates a stop device for a downhole tool according to the invention.

Figure 1:
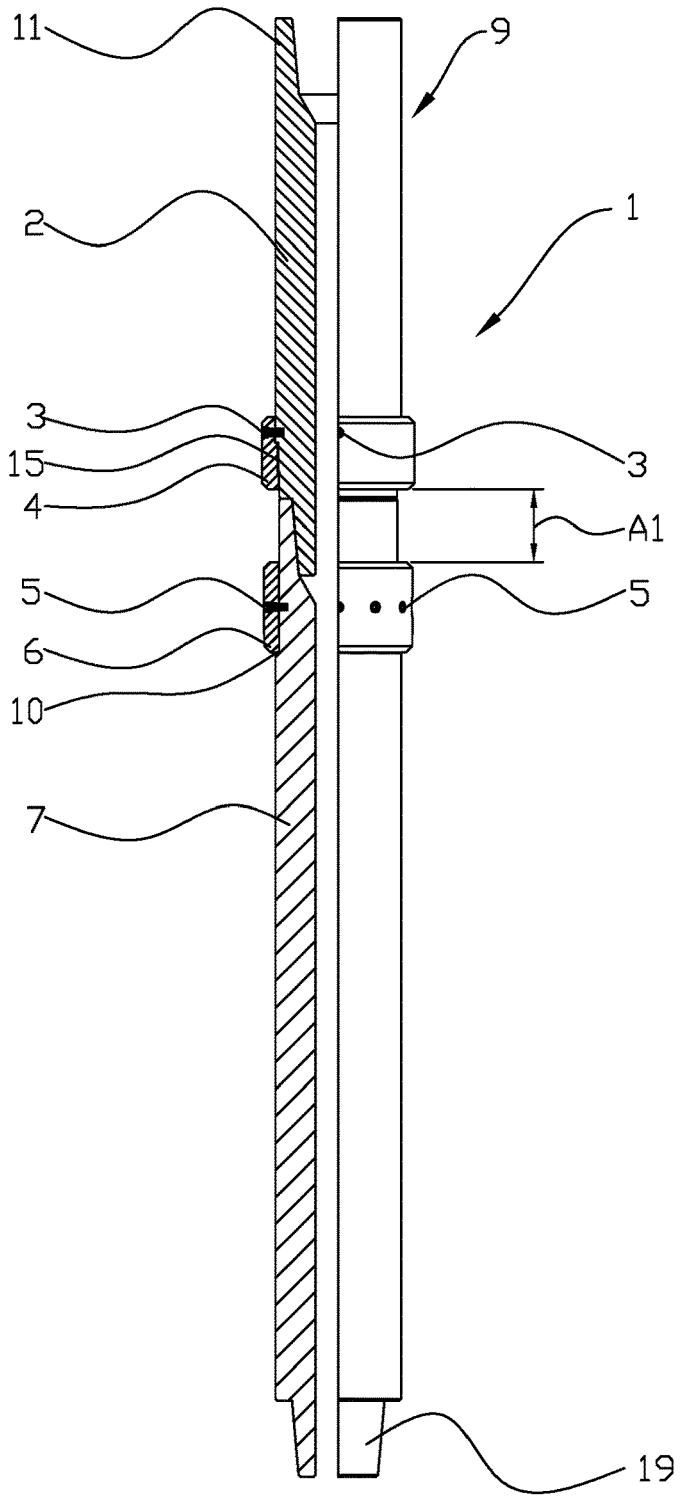
FIG. 1 shows a partial section of a stop device according to the invention.

The stop device 1 as shown in FIG. 1 includes a first stop collar 4 and a second stop collar 6 placed a distance A1 apart. In the embodiment shown, the stop collars 4, 6 are fixed around a pipe string 9, the pipe string 9 having a first end portion 11 and a second end portion 19. The pipe string 9 is shown as a two-part pipe string comprising an upper pipe-string section 2 and a lower pipe-string section 7. The pipe string sections 2, 7 are connected by complementary threaded connections of a type known per se. In the embodiment shown, a pipe string 9 is shown, but the stop device 1 may be attached to other elongated bodies, for example a cylinder, a bolt or other bodies fulfilling the purpose of the present invention.

The first stop collar 4 is permanently attached to the pipe string 9 by means of set screws 3 and a threaded portion 15. The second stop collar 6 is attached to the pipe string by means of shear pins 5.

Figure 2:
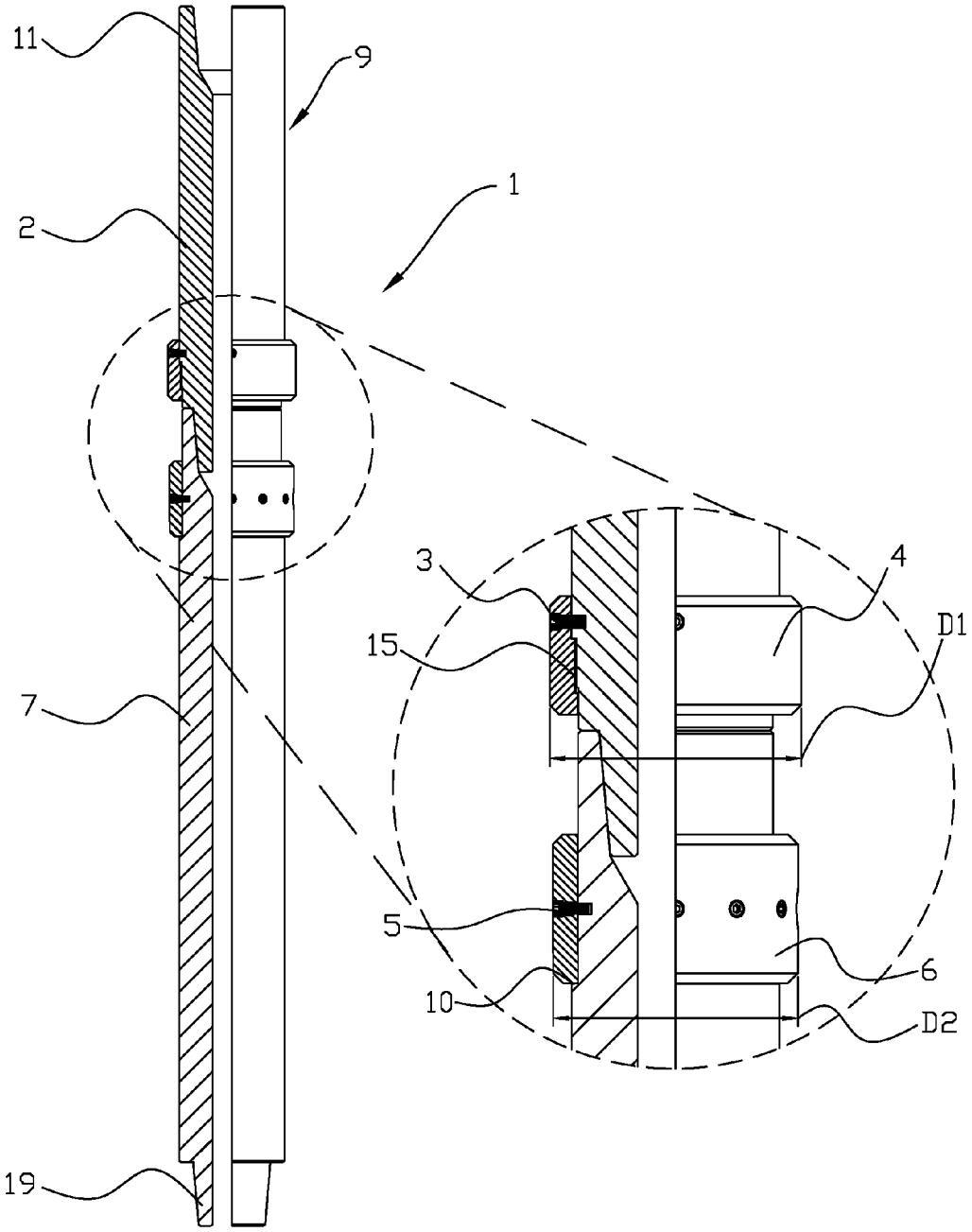
FIG. 2 shows a section of FIG. 1 on a larger scale.

The first stop collar 4 has an external diameter D1 somewhat larger than the external diameter D2 of the second stop collar 6, see FIG. 2. It is thereby achieved that the second stop collar 6 does not come into contact with the well wall when the stop device 1 is carried into and out of a well. It is desirable for the second stop collar not to come into contact with the well wall when being carried into and out of a well because this may involve the risk of the shear pins 5 weakening or breaking. The external diameters D1, D2 of the stop collars 4, 6 are adapted in such a way that the stop collars may hit a casing 8 when being run into a well, see FIG. 3. However, it will be understood that the external diameters D1, D2 of the stop collars 4, 6 may be equal.

When a downhole tool 20 is being run into a well, the downhole tool may be attached to the second end portion 19 of the piper string 9. The downhole tool may be a pulling tool with grippers, for example. When the pulling tool is being run into the well, the running-in distance is restricted by the second stop collar 6 of the stop device 1 hitting the casing 8, see FIG 3A. The pulling tool is locked by the pipe string 9 being pulled in the direction out of the well.

When the pulling tool is being disengaged, the pipe string 9 is first pulled a distance in the direction out of the well, then the pipe string 9 is dropped back down in the well so that a sufficiently great force is achieved to break the shear pins 5 when the second stop collar 6 hits the casing 8, see FIG. 3B. Further movement into the casing 8 is prevented by the second stop collar 6 further hitting the first stop collar 4.

The number of shear pins 5, the dimension of the shear pins 5 and the material from which they are made are selected in a known manner on the basis of the axial force to be required in order to break the shear pins 5. The shear pins 5 may be made in a known manner as screws 5.

In an alternative embodiment (not shown), the second collar 6 may be displaceably attached to the pipe string 9 with other types of attachments that disengage or break at a given force. Such attachments may consist of threads, recesses and complementary grooves, for example. In a further alternative embodiment, the second collar 6 may consist of a material that will make the collar 6 itself break at a given force. Examples of such materials are aluminium, brass, other metals, polymer materials and composite materials.

When the released pulling tool is being pulled out of the well, the second stop collar 6 is prevented from falling off the pipe string 9 by the pipe string 9 being provided with an edge 10 that will hit the second stop collar 6 as the stop collar 6 moves downwards.

The invention claimed is:

1. A downhole-tool stop device, the stop device including a first stop collar permanently and non-moveably attached to a section of pipe string, the section of pipe string having a first end portion and a second end portion, the first end portion and second end portion having standard threaded connections to connect the section of pipe string into a pipe string to surface, characterized in that the stop device includes a second stop collar being displaceably attached to the section of pipe string, and the first stop collar and the second stop collar being placed a distance apart.

2. The stop device according to claim 1, wherein the second stop collar is displaceably attached to the section of pipe string with at least one rupture body.

3. The stop device according to claim 2, wherein the at least one rupture body is taken from the group consisting of shear screws and shear pins.

4. The stop device according to claim 2, wherein the at least one rupture body is arranged substantially perpendicularly to the longitudinal direction of the section of pipe string.

5. The stop device according to claim 1, wherein the second stop collar is attached closer to a second end portion of the section of pipe string than the first stop collar.

6. The stop device according to claim 1, wherein the section of pipe string comprises a two-part section of pipe string.

7. The stop device according to claim 6, wherein an upper section and a lower section of the section of pipe string are threadedly connected.

8. The stop device according to claim 7, wherein the lower section of the section of pipe string is provided with an edge portion arranged to hit the second stop collar.

9. The stop device according to claim 1, wherein an outer diameter of the first stop collar is larger than an outer diameter of the second stop collar.

10. The stop device according to claim 1, wherein a downhole tool is attached to a second end portion of the section of pipe string.

11. A method of using a stop device according to claim 1 to release a downhole tool from an underground well, characterized in that the method comprises the steps of:

attaching a downhole tool to the second end portion of the stop device;

running the downhole tool attached to the stop device on a pipe string from surface into an underground well until the second stop collar of the stop device hits a casing;

engaging the downhole tool with the casing by moving the downhole tool and the stop device in a direction out of the underground well;

releasing the engagement of the downhole tool with the casing by moving the downhole tool and the stop device in a direction into the well so that the shear pins of the second stop collar break.

* * * * *